US011493945B1

(12) United States Patent
Wang et al.

(10) Patent No.: US 11,493,945 B1
(45) Date of Patent: Nov. 8, 2022

(54) METHOD AND APPARATUS FOR MITIGATING PERFORMANCE DEGRADATION IN DIGITAL LOW-DROPOUT VOLTAGE REGULATORS (DLDOS)

(71) Applicants: University of South Florida, Tampa, FL (US); REGENTS OF THE UNIVERSITY OF MINNESOTA, Minneapolis, MN (US)

(72) Inventors: Longfei Wang, Tampa, FL (US); S. Karen Khatamifard, Los Angeles, CA (US); Ulya R. Karpuzcu, Minneapolis, MN (US); Selçuk Köse, Tampa, FL (US)

(73) Assignees: UNIVERSITY OF SOUTH FLORIDA, Tampa, FL (US); REGENTS OF THE UNIVERSITY OF MINNESOTA, Minneapolis, MN (US)

( * ) Notice: Subject to any disclaimer, the term of this patent is extended or adjusted under 35 U.S.C. 154(b) by 0 days.

(21) Appl. No.: 16/692,389

(22) Filed: Nov. 22, 2019

Related U.S. Application Data

(60) Provisional application No. 62/786,470, filed on Dec. 30, 2018.

(51) Int. Cl.
*G05F 1/00* (2006.01)
*G05F 1/59* (2006.01)
*G05F 1/575* (2006.01)

(52) U.S. Cl.
CPC ..... *G05F 1/59* (2013.01); *G05F 1/575* (2013.01)

(58) Field of Classification Search
CPC ..... G05F 1/00; G05F 1/10; G05F 1/12; G05F 1/59; G05F 1/575
See application file for complete search history.

(56) References Cited

U.S. PATENT DOCUMENTS 6,518,737 B1 2/2003 Stanescu
6,703,815 B2 3/2004 Biagi
9,136,764 B2 * 9/2015 Krellner ..... H02M 3/1584
(Continued)

OTHER PUBLICATIONS

Ahn et al., "A Multiphase Buck Converter with a Rotating Phase-Shedding Scheme for Efficient Light-Load Control", IEEE JSSC, vol. 49, No. 11, Nov. 2014, pp. 2673-2683.
(Continued)

*Primary Examiner* — Adolf D Berhane
*Assistant Examiner* — Afework S Demisse
(74) *Attorney, Agent, or Firm* — Quarles & Brady LLP

(57) ABSTRACT

An apparatus and method are provided for mitigating performance degradation in digital low-dropout voltage regulators (DLDOs) caused by the effects of aging on the power transistors of the DLDO, such as by the effects of negative bias temperature instability (NBTI)-induced aging, for example. The apparatus comprises a shift register for use in a DLDO that is configured to activate and deactivate power transistors of the DLDO to evenly distribute electrical stress among the transistors in a way that mitigates performance degradation of the DLDO under various load current conditions. In addition, the shift register and methodology can be implemented in such a way that nearly no extra power and area overhead are consumed.

20 Claims, 11 Drawing Sheets

(56) References Cited

U.S. PATENT DOCUMENTS

| | | | | |
|---|---|---|---|---|
| 9,946,281 | B1 | 4/2018 | Huang | |
| 2004/0041543 | A1* | 3/2004 | Brooks | H02M 3/1584 323/212 |
| 2004/0095020 | A1* | 5/2004 | Kernahan | H02M 3/157 307/35 |
| 2004/0150610 | A1 | 8/2004 | Zebedee | |
| 2005/0040800 | A1 | 2/2005 | Sutardja | |
| 2008/0157740 | A1 | 7/2008 | Gurcan | |
| 2011/0248688 | A1 | 10/2011 | Iacob et al. | |
| 2018/0329440 | A1 | 11/2018 | Jefremow | |

OTHER PUBLICATIONS

Muthukaruppan et al., "A Digitally Controlled Linear Regulator for Per-Core Wide-Range DVFS of AtomTM Cores in 14nm Tri-Gate CMOS Featuring Non-Linear Control, Adaptive Gain and Code Roaming", 2017 IEEE, 978-1-590-523-3/17/$31.00, pp. 275-278.

Atra et al., "A Reliable Digitally Synthesizable Linear Drop-Out Regulator Design for 14nm SOC", 2015 IEEE Int. Symposium on Nanoelectronic and Information Systems, IEEE Computer Society, 978-1-473-9692-9/15, pp. 73-76.

Lorentz et al., "Lossless Average Inductor Current Sensor for CMOS Integrated DC-DC Converters Operating at High Frequencies", Analog Integr. Circ. and Signal Proc., vol. 62, No. 3, pp. 333-344, 2009.

Nasir et al., "A Modle Study of an All-Digital, Discrete-Time and Embedded Linear Regulator," arXiv 1501.00579 [cs.AR], [on-line], pp. 1-5.

Nasir et al., "All-Digital Low-Dropout Regulator with Adaptive Control and Reduced Dynamic Stability for Digital Load Circuits", IEEE Trans. Power Electron., vol. 31, No. 12, pp. 8293-8302, Dec. 2016.

* cited by examiner

| $Q_1$ | $Q_2$ | $Q_3$ | $Q_4$ | $Q_5$ | $Q_6$ | ... | ... | $Q_{N-1}$ | $Q_N$ |
|---|---|---|---|---|---|---|---|---|---|
| (1) Initialize: all $M_i$ turned off | | | | | | | | | |
| 1 | 1 | 1 | 1 | 1 | 1 | ... | ... | 1 | 1 |
| (2) Step k | | | | | | | | | |
| 0 | 0 | 1 | 1 | 1 | 1 | ... | ... | 1 | 1 |
| (3) Step k+1: Shift right ➡ | | | | | | | | | |
| 0 | 0 | 0 | 1 | 1 | 1 | ... | ... | 1 | 1 |
| (4) Step k+2: Shift right ➡ | | | | | | | | | |
| 0 | 0 | 0 | 0 | 1 | 1 | ... | ... | 1 | 1 |
| (5) Step k+3: Shift left ⬅ | | | | | | | | | |
| 0 | 0 | 0 | 1 | 1 | 1 | ... | ... | 1 | 1 |
| (6) Step k+4: Shift left ⬅ | | | | | | | | | |
| 0 | 0 | 1 | 1 | 1 | 1 | ... | ... | 1 | 1 |

FIG. 8
(PRIOR ART)

| $Q_1$ | $Q_2$ | $Q_3$ | $Q_4$ | $Q_5$ | $Q_6$ | ... | ... | $Q_{N-1}$ | $Q_N$ |
|---|---|---|---|---|---|---|---|---|---|
| (1) Initialize: all $M_i$ turned off | | | | | | | | | |
| 1 | 1 | 1 | 1 | 1 | 1 | ... | ... | 1 | 1 |
| (2) Step k | | | | | | | | | |
| 1 | 1 | 0 | 0 | 1 | 1 | ... | ... | 1 | 1 |
| (3) Step k+1: Shift right ➡ | | | | | | | | | |
| 1 | 1 | 0 | 0 | 0 | 1 | ... | ... | 1 | 1 |
| (4) Step k+2: Shift right ➡ | | | | | | | | | |
| 1 | 1 | 0 | 0 | 0 | 0 | ... | ... | 1 | 1 |
| (5) Step k+3: Shift right ➡ | | | | | | | | | |
| 1 | 1 | 1 | 0 | 0 | 0 | ... | ... | 1 | 1 |
| (6) Step k+4: Shift right ➡ | | | | | | | | | |
| 1 | 1 | 1 | 1 | 0 | 0 | ... | ... | 1 | 1 |

FIG. 9

TABLE I
TECHNOLOGY AND ARCHITECTURE PARAMETERS

| |
|---|
| Technology node: 22nm, Frequency: 4.0GHz<br>TDP: 150W, Area: $441mm^2$, Vdd: 1.03V |
| # cores: 8, issue width: 8<br>64 architectured FRF, 32 architectured IRF |
| L1-I cache: 32KB, 8-way, 64B, LRU, 1-cycle hit<br>L1-D cache: 64KB, 8-way, 64B, LRU, 1-cycle hit<br>L2 cache: 512KB, 8-way, 128B, LRU, 11-cycle hit<br>L3 cache: 64MB, 8-way, 128B, LRU, 30-cycle hit |

TABLE II

LOAD CHARACTERISTICS OF DIFFERENT FUNCTIONAL BLOCKS WITHIN ONE CORE OF AN IBM POWER8 LIKE MICROPROCESSOR CHIP UNDER ALL EXPERIMENTED BENCHMARKS

| | IFU | LSU | ISU | EXU | L2 |
|---|---|---|---|---|---|
| Min $I_{load}$ (A) | 0.091 | 0.172 | 0.125 | 0.251 | 0.178 |
| Max $I_{load}$ (A) | 3.245 | 12.092 | 1.356 | 5.056 | 2.195 |
| Avg $I_{load}$ (A) | 1.138 | 0.908 | 0.201 | 1.294 | 1.719 |

FIG. 14

TABLE III
CONVENTIONAL DLDO PERFORMANCE DEGRADATION FOR DIFFERENT FUNCTIONAL BLOCKS UNDER ALL EXPERIMENTED BENCHMARKS FOR A FIVE-YEAR TIME FRAME

| | IFU | LSU | ISU | EXU | L2 |
|---|---|---|---|---|---|
| % $I_{pMOS}$ degradation | 16.2 | 21.4 | 15.3 | 16.6 | 15.1 |
| % $T_R$ degradation | 9.4 | 12.9 | 8.9 | 9.7 | 8.7 |
| % $\Delta V$ degradation | 6.4 | 8.7 | 6.1 | 6.6 | 6 |

FIG. 15

METHOD AND APPARATUS FOR MITIGATING PERFORMANCE DEGRADATION IN DIGITAL LOW-DROPOUT VOLTAGE REGULATORS (DLDOS)

CROSS-REFERENCE TO RELATED APPLICATIONS

This application claims priority to, and the benefit of the filing date of, U.S. provisional application No. 62/786,470, filed on Dec. 30, 2018, entitled "METHOD AND APPARATUS FOR MITIGATING PERFORMANCE DEGRADATION IN DIGITAL LOW-DROPOUT VOLTAGE REGULATORS (DLDOs)," which is hereby incorporated by reference herein in its entirety.

GOVERNMENT RIGHTS STATEMENT

This invention was made with government support under grant No. CCF1350451 awarded by the National Science Foundation. The government has certain rights in this invention.

TECHNICAL FIELD

The invention relates to digital low-dropout voltage regulators (DLDOs).

BACKGROUND

With ubiquitous applications of on-chip voltage regulation within modern microprocessors, Internet of Things (IoT), wireless energy harvesting, and applications such as aerospace engineering, the reliable operation and lifetime of on-chip voltage regulators have become one of the most significant and challenging design considerations. Within those applications, large variations in the load current, voltage, and temperature can occur. These variations may speed up the aging process of the devices under stress and further deteriorate the performance and lifetime of on-chip voltage regulators. As those regulators are already deployed in the field, replacement of them can be costly or even impossible. The conflicting need of harsh environment applications and highly reliable designs necessitates reliability evaluations at the design stage as well as reliability enhancement techniques.

The major transistor aging mechanisms include bias temperature instability (BTI), hot carrier injection (HCI), and time dependent dielectric breakdown (TDDB), among which BTI is the dominant reliability concern for nanometer integrated circuits design. BTI can induce threshold voltage increase and consequent circuit level performance degradation. Positive BTI (PBTI) induces aging of nMOS transistors while negative BTI (NBTI) causes aging of pMOS transistors. The impact of the BTI aging mechanism is a strong function of temperature, electrical stress, and time.

On the other hand, as an essential part of large scale integrated circuits, on-chip voltage regulators need to be active most of the time to provide the required power to the load circuit. The load current and temperature can vary quite a bit, especially for microprocessor applications. All of these variations partially contribute to different aging mechanisms of on-chip voltage regulators, which should be considered to avoid overdesign for a targeted lifetime.

Several studies have been performed regarding the reliability issues in nanometer CMOS designs. There is, however, quite limited amount of work on the reliability of on-chip voltage regulators. Device aging on the immunity level of electro-magnetic interference (EMI) for LDO has been studied. A method of distributing the aging stress by rotating the phase to shed at light load has been proposed to enhance the light load efficiency for multiphase buck converters. The reliability of metal wires connected to on-chip voltage regulators has been investigated. Nonetheless, quantitative analysis of aging effects on on-chip voltage regulators considering load current characteristics and temperature variations as well as efficient reliability enhancement techniques under arbitrary load conditions have not yet been investigated.

As compared to other voltage regulator types, the emerging DLDO has gained impetus due to the design simplicity, easiness for integration, high power density, and fast response. DLDOs have demonstrated major advantages in modern processors including the recent IBM POWER8 processor. More importantly, as compared to the analog LDOs, DLDOs can provide certain advantages for low-power and low-voltage IoT applications due to its capability for low supply voltage operations. However, as pMOS is used as the power transistor for DLDOs, NBTI induced degradations largely affect important performance metrics such as the maximum output current capability $I_{max}$, load response time $T_R$, and magnitude of the droop $\Delta V$. It is therefore imperative to investigate aging mitigation techniques for DLDOs to achieve reliable operation of critical systems.

FIG. 1 is a schematic diagram of a conventional DLDO 2. The DLDO 2 is composed of N parallel pMOS transistors $M_i$ (i=1, . . . , N) connected between the input voltage $V_{in}$ and output voltage $V_{out}$, and a feedback control loop implemented with a clocked comparator 3 and a digital controller 4. The value of $V_{out}$ and reference voltage $V_{ref}$ are compared through the comparator 3 at the rising edge of the clock signal, clk. A larger (smaller) number of $M_i$ are turned on/off through the digital controller 4 output signals $Q_i$ (i=1, . . . , N) if $V_{out}<V_{ref}$, $V_{amp}$ H ($V_{out}>V_{ref}$, $V_{cmp}$=L). FIG. 2 is a block diagram of a bi-directional shift register (bDSR) 5 that is conventionally implemented for the digital controller 4 of the DLDO 2 shown in FIG. 1 to turn on (off) power transistors $M_1$ to $M_m$ ($M_{m+1}$ to $M_N$) with the value of m decided by the load current $I_{out}$. FIG. 3 is a diagram showing the operation of the bDSR 5 shown in FIG. 2. At a certain step k+1, $M_{m+1}$($M_m$) is turned on (off) if $V_{cmp}$=H ($V_{cmp}$=L) and bDSR 5 shifts right (left) as demonstrated in FIG. 3.

The DLDO 2 needs to be able to supply the maximum possible load current $I_{max}$. It is, however, demonstrated that, within most practical applications, including but not limited to smart phone and chip multiprocessors, less than the average power is consumed most of the time. The application environment of DLDO together with the conventional activation scheme of $M_i$ leads to the heavy use of $M_1$ to $M_m$ and less or even no use of $M_{m+1}$ to $M_N$. This scheme can therefore introduce serious degradation to $M_1$ to $M_m$ due to NBTI.

BRIEF DESCRIPTION OF THE DRAWINGS

The example embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

FIG. 8 is a timing diagram that represents simulated steady-state gate signals of power transistors with bDSR control as shown in FIG. 2.

FIG. 9 is a timing diagram that represents simulated steady-state gate signals of bower transistors with uDSR control as shown in FIG. 7.

FIG. 14 is a table listing load characteristics of the different functional blocks shown in FIG. 13 under experimented benchmarks.

FIG. 15 is a table listing simulation results for conventional DLDO performance degradation for different functional blocks shown in FIG. 12 under experimented benchmarks for a five-year time frame.

DETAILED DESCRIPTION

Figure 1:
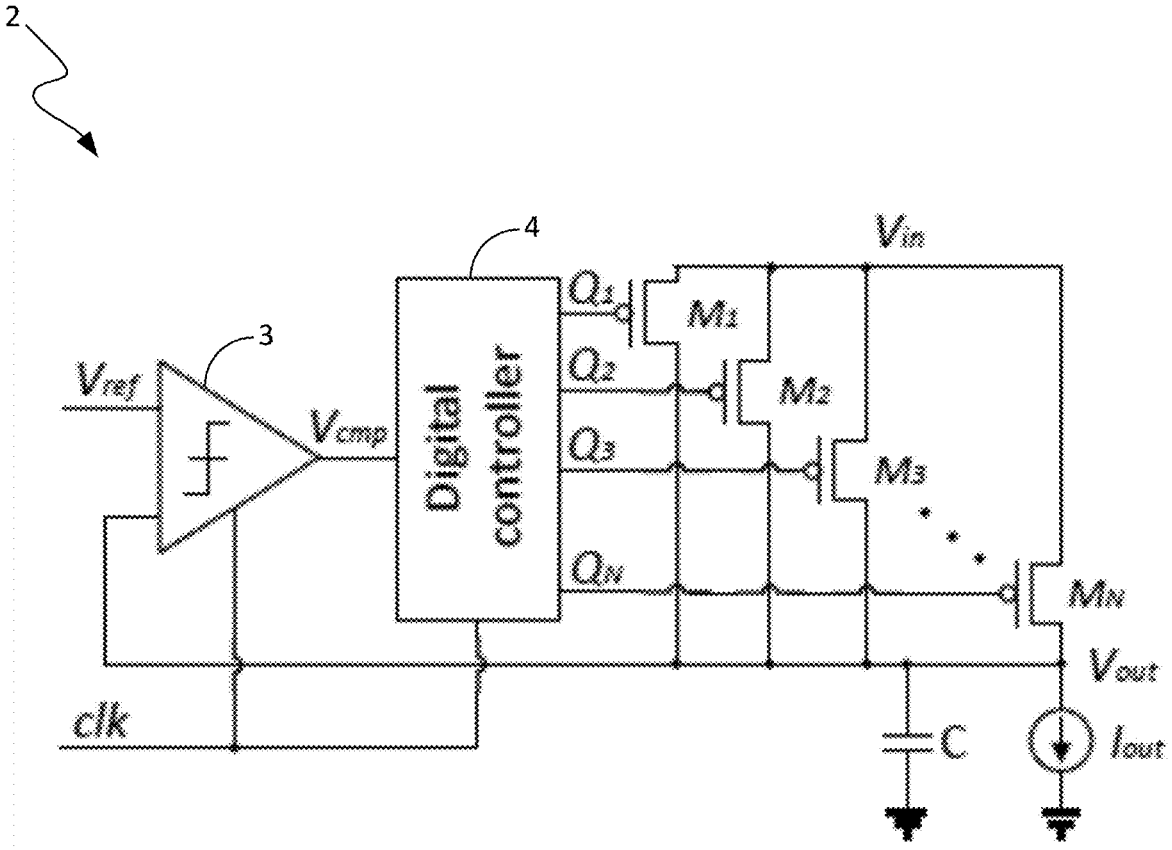
FIG. 1 (PRIOR ART)
FIG. 1 is a schematic diagram of a conventional DLDO.

The present disclosure discloses a DLDO having a configuration that mitigates performance degradation caused by the effects of aging on power transistors of the DLDO. In accordance with an embodiment, the apparatus comprises a digital controller comprising a shift register that is configured to activate and deactivate power transistors of the DLDO to evenly distribute electrical stress among the transistors over time in a way that mitigates performance degradation of the DLDO under various load current conditions.

In the following detailed description, for purposes of explanation and not limitation, exemplary, or representative, embodiments disclosing specific details are set forth in order to provide a thorough understanding of inventive principles and concepts. However, it will be apparent to one of ordinary skill in the art having the benefit of the present disclosure that other embodiments according to the present teachings that are not explicitly described or shown herein are within the scope of the appended claims. Moreover, descriptions of well-known apparatuses and methods may be omitted so as not to obscure the description of the exemplary embodiments. Such methods and apparatuses are clearly within the scope of the present teachings, as will be understood by those of skill in the art. It should also be understood that the word "example," as used herein, is intended to be non-exclusionary and non-limiting in nature.

The terminology used herein is for purposes of describing particular embodiments only, and is not intended to be limiting. The defined terms are in addition to the technical, scientific, or ordinary meanings of the defined terms as commonly understood and accepted in the relevant context.

The terms "a," "an" and "the" include both singular and plural referents, unless the context clearly dictates otherwise. Thus, for example, "a device" includes one device and plural devices. The terms "substantial" or "substantially" mean to within acceptable limits or degrees acceptable to those of skill in the art. The term "approximately" means to within an acceptable limit or amount to one of ordinary skill in the art.

As an essential part of large scale integrated circuits, on-chip voltage regulators need to be active most of the time to provide the required power to the load circuit. The load current and temperature can vary quite a bit, especially for microprocessor applications. These variations partially contribute to different aging mechanisms of on-chip voltage regulators, which should be considered to avoid overdesign for a targeted lifetime. Additionally, in certain processor components that can show higher degrees of tolerance to errors, the regulators can be intentionally under-designed to save valuable chip area and potentially power-conversion efficiency. In other words, a heterogeneous distributed power delivery network can be designed comprising different DLDOs including accurate DLDOs that house additional circuitry to mitigate the aging-induced supply voltage variations and approximate DLDOs that are intentionally under-designed to mitigate, just enough, aging-induced variations. The quality of the supply voltage directly affects the data path delay and signal quality, and fluctuations in the supply voltage result in delay uncertainty and clock jitter. According to one aspect of the present disclosure, the supply noise tolerance of certain processor components is used as an "area quality control knob" that compromises the quality of the supply voltage to save valuable chip area.

Several studies have been performed regarding the reliability issues in nanometer CMOS designs. To date, only a limited amount of work has been done on the reliability of on-chip voltage regulators. To this end, the present disclosure provides a quantitative analysis of aging effects on on-chip voltage regulators considering load current characteristics and temperature variations as well as efficient reliability enhancement techniques under arbitrary load conditions.

As compared to other voltage regulator types, the emerging DLDO has gained impetus due to the design simplicity, easiness for integration, high power density, and fast response. DLDOs have demonstrated major advantages in modern processors including the recent IBM POWER8 processor. More importantly, as compared to the analog LDOs, a DLDO can provide certain advantages for low-power and low-voltage IoT applications due to its capability for low supply voltage operations. However, as pMOS is used as the power transistor for DLDOs, NBTI-induced degradations largely affect important performance metrics such as the maximum output current capability $I_{max}$, load response time $T_R$, and magnitude of the droop $\Delta V$.

The present disclosure is organized as follows. Background information regarding the conventional DLDO shown in FIG. 1 is introduced in Section I. NBTI-induced DLDO regulator performance degradation including $I_{max}$, $T_R$, and $\Delta V$ is demonstrated theoretically in Section II. A representative embodiment of an aging-aware (A-A) DLDO in accordance with the inventive principles and concepts is described in Section III. A benefits evaluation of the A-A DLDO through simulation of an IBM POWER8 like processor is provided in Section IV. Concluding remarks are offered in Section V.

Section I

A. Negative Bias Temperature Instability

NBTI can introduce significant $V_{th}$ degradations to pMOS transistors due to negatively applied gate to source voltage $V_{gs}$. The increase in $|V_{th}|$ due to NBTI is considered to be related to the generation of interface traps at the Si/SiO2 interface when there is a gate voltage. $|V_{th}|$ increases when electrical stress is applied and partially recovers when stress is removed. This process is commonly explained using a reaction-diffusion (R-D) model. The $V_{th}$ degradation can be estimated during each stress and recovery phase using a cycle-to-cycle model and can also be evaluated using a long-term reliability model. As the long-term reliability evaluation is the focus of this work, the analytical model for long-term worst case threshold voltage degradation $\Delta V_{th}$ estimation can be expressed as:

$$\Delta V_{th} = K_{lt}\sqrt{C_{ox}(|V_{gs}| - |V_{th}|)}\, e^{\frac{-E_a}{kT}} (\alpha t)^{\frac{1}{6}} \tag{1}$$

where $C_{ox}$, k, T, $\alpha$, and t are, respectively, the oxide capacitance, Boltzmann constant, temperature, the fraction of time (activity factor) when the device is under stress, and operation time. $K_{lt}$ and $E_a$ are the fitting parameters to match the model with the experimental data. Note that NBTI recovery phase is already included in the model.

Section II. Aging-Induced DLDO Performance Degradation $I_{max}$, $T_R$, and $\Delta V$ are among the most important design parameters for DLDOs. The effect of NBTI-induced degradations on these important performance metrics is examined in this section.

A. Maximum Current Supply Capability

Without NBTI induced degradations, $I_{max}=NI_{pMOS}$, where $I_{pMOS}$ is the maximum output current of a single pMOS stage. For the DLDO, $|V_{gs}|$ in Equation (1) is equal to $V_{in}$ when $M_i$ is active. The pMOS transistor $M_i$ operates in linear region when turned on and the on-resistance $R_{on}$ of a single pMOS stage can be approximated as:

$$R_{on} \approx [(W/L)/\mu_p C_{ox}(V_{in} - |V_{th}|)]^{-1} \tag{2}$$

where W, L, $\mu_p$, and $C_{ox}$ are, respectively, the width, length, mobility, and oxide capacitance of $M_i$. $I_{pMOS}$ can thus be expressed as:

$$I_{pMOS} = \frac{V_{sd}}{R_{on}} = (V_{in} - V_{out})(W/L)\mu_p C_{ox}(V_{in} - |V_{th}|) \tag{3}$$

where $V_{sd}$ is the source drain voltage of $M_i$. NBTI induced degradation factor $DF_i$ for $M_i$ can be defined as:

$$DF_i = \frac{I_{pMOS_i}^{deg}}{I_{pMOS}} = \frac{V_{in} - |V_{th}| - \Delta V_{th_i}}{V_{in} - |V_{th}|} \tag{4}$$

where $\Delta V_{th_i}$ and $I_{pMOS_i}^{deg}$ are, respectively, NBTI induced $V_{th}$ degradation and the degraded $I_{pMOS}$ for $M_i$. Degraded $I_{max}$ can be expressed as:

$$I_{max}^{deg} = I_{pMOS}\Sigma_{i=1}^{N} DF_i. \tag{5}$$

Figure 4:
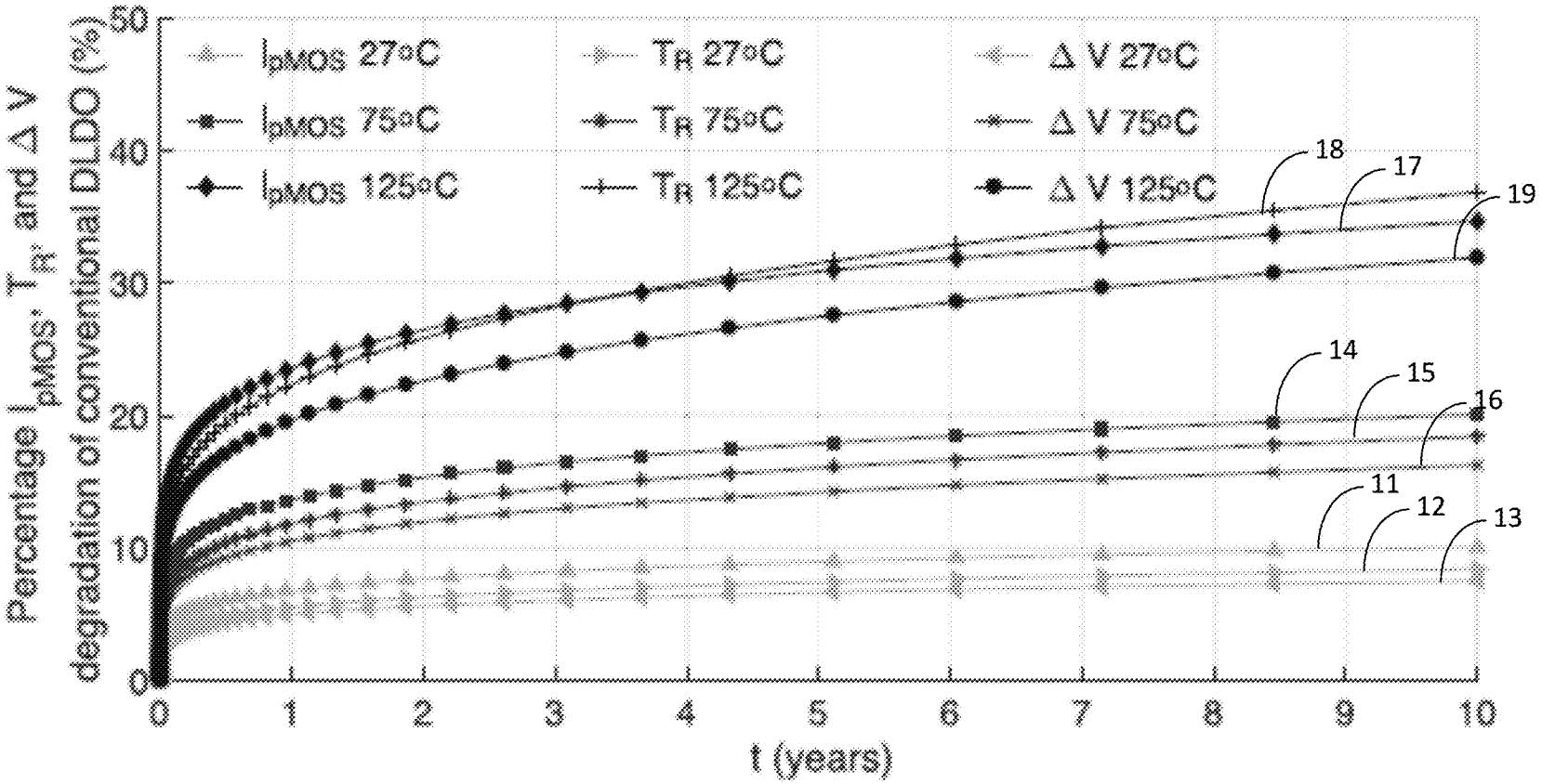
FIG. 4 is a graph showing the percentage of $I_{pMOS}$ degradation over time of a DLDO of the type shown in FIG. 1 that uses a bi-directional shift register of the type shown in FIG. 2.

FIG. 4 is a plot showing percentage $I_{pMOS}$, $T_R$, and $\Delta V$ degradation for bDSR-based DLDOs of the type shown in FIG. 1 for different temperatures. Curves 11-13 correspond to $I_{pMOS}$, $T_R$ and $\Delta V$, degradation, respectively, for 27° C. Curves 14-16 correspond to $I_{pMOS}$, $T_R$ and $\Delta V$, degradation, respectively, for 75° C. Curves 17-19 correspond to $I_{pMOS}$, $T_R$ and $\Delta V$, degradation, respectively, for 125° C. As an example, the percentage $I_{pMOS}$ degradation $1-DF_i$ for a smaller value of i, considering $M_i$ is active most of the time, is shown in FIG. 4 as a function of time under different temperatures. Equations (1) and (4) are leveraged for evaluation, where transistor model parameters are adopted from a 32-nm metal gate, high-k strained-Si CMOS technology within the predictive technology model (PTM) model library. A supply voltage $V_{in}$=1.1 V is used for estimation. PTM is adopted for the aging-induced deterioration analysis and subsequent DLDO simulations as it is widely used for BTI study due to the availability of fitting parameter values in the $\Delta V_{th}$ degradation model. As shown in FIG. 4, NBTI can induce significant $I_{pMOS}$ degradations, especially at high temperatures. Also, most degradation occurs in the first two years. Beyond two years, the degradation typically plateaus to within 10%. Degraded $I_{pMOS}$ can further lead to reduced $I_{max}$ and lower output voltage regulation capability under high load current. Moreover, as discussed in Sections II-B and II-C, degraded $I_{pMOS}$ also exacerbates $T_R$ and $\Delta V$, necessitating reliability enhancement techniques.

B. Load Response Time

Load response time $T_R$ measures how fast the feedback loop responds to a step load. $T_R$ can be estimated as:

$$T_R = RC\ln\left(1 + \frac{\Delta i_{load}}{I_{pMOS} f_{clk} RC}\right) \tag{6}$$

where R, C, $f_{clk}$, and $\Delta i_{load}$ are, respectively, the average DLDO output resistance before and after $\Delta i_{load}$, load capacitance, clock frequency, and amplitude of the load change. Considering NBTI effect, degraded $T_R$ can be expressed as:

$$T_R^{deg} = RC\ln\left(1 + \frac{\Delta i_{load}}{DF I_{pMOS} f_{clk} RC}\right). \tag{7}$$

As $0<DF<1$ and $T_R<T_R^{deg}$, NBTI induced degradation slows down DLDO response.

C. Magnitude of the Droop

Magnitude of the droop $\Delta V$ reflects the $V_{out}$ noise profile under transient response and can be estimated as:

$$\Delta V = R\Delta i_{load} - I_{pMOS} f_{clk} R^2 C\ln\left(1 + \frac{\Delta i_{load}}{I_{pMOS} f_{clk} RC}\right). \tag{8}$$

Considering NBTI effect, degraded ΔV can be expressed as:

$$\Delta V_{deg} = R\Delta i_{load} - DFI_{pMOS} f_{clk} R^2 C \ln\left(1 + \frac{\Delta i_{load}}{DFI_{pMOS} f_{clk} RC}\right). \quad (9)$$

Let $\Delta i_{load}/I_{pMOS} f_{clk} RC = A$, $A>0$. Under $0<DF<1$, the following holds:

$$1 + A > \left(1 + \frac{A}{DF}\right)^{DF} \quad (10)$$

$$I_{pMOS} f_{clk} R^2 C \ln\left(1 + \frac{\Delta i_{load}}{I_{pMOS} f_{clk} RC}\right) > DFI_{pMOS} f_{clk} R^2 C \ln\left(1 + \frac{\Delta i_{load}}{DFI_{pMOS} f_{clk} RC}\right) \quad (11)$$

and $\Delta V<\Delta V_{deg}$, which means NBTI can degrade the transient voltage noise profile.

Section III. Aging-Aware (A-A) DLDO

Figure 5:
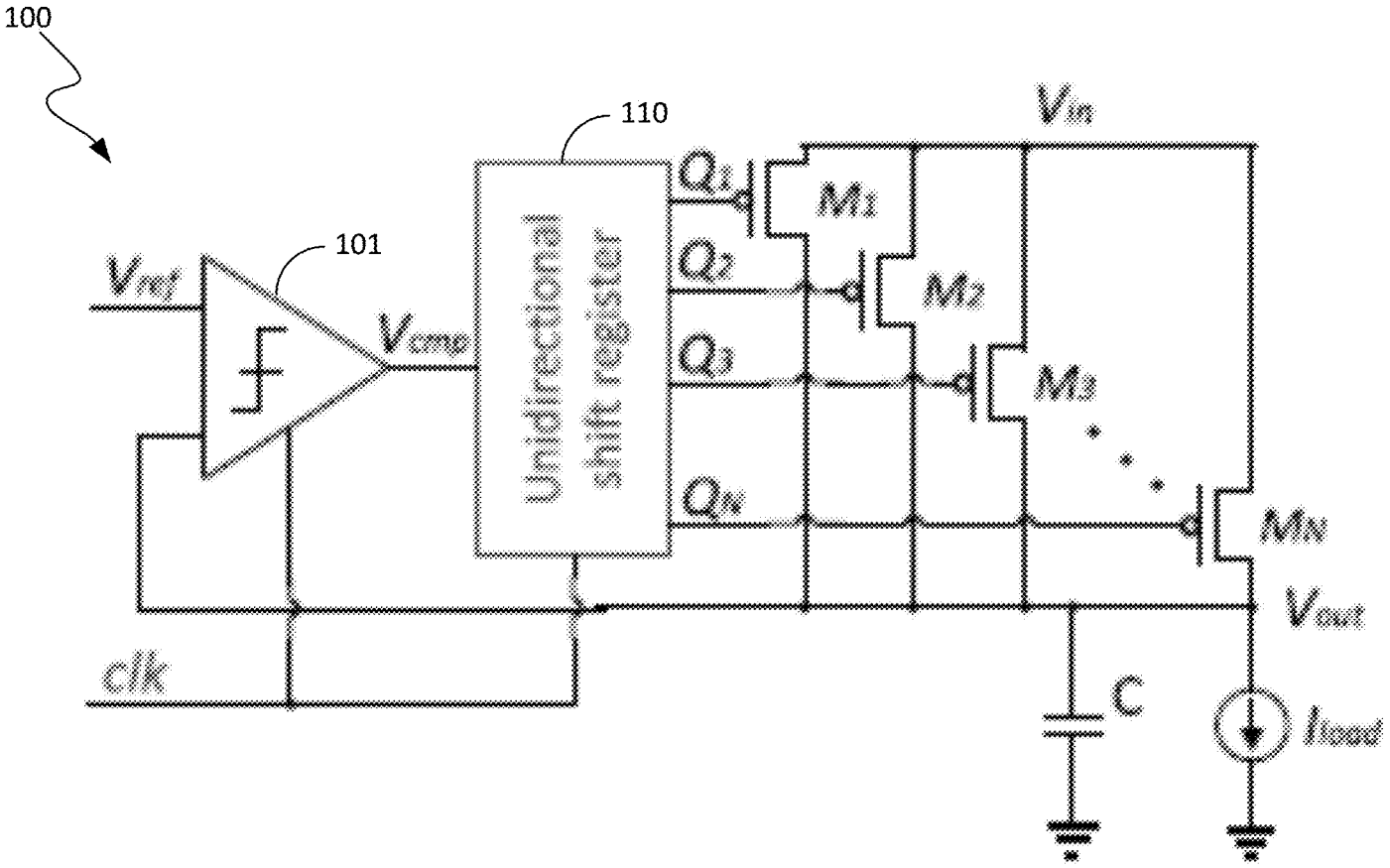
FIG. 5 is a schematic diagram of an aging-aware (A-A) DLDO in accordance with a representative embodiment.

Considering the side effects of power transistor array and control loop degradations, a representative embodiment of an A-A DLDO 100 is shown in FIG. 5. The A-A DLDO 100 employs a unidirectional shift register (uDSR) 110 to mitigate, respectively, $I_{pMOS}$, $T_R$, and ΔV degradation. The uDSR 110 is described below in detail in section III-A. Power and area OH of the proposed technique as well as compatibility analysis are provided in Section III-B.

N parallel pMOS power transistors $M_i$ (i=1, . . . , N) of the DLDO 100 are connected between the input voltage $V_{in}$ and output voltage $V_{out}$, and a feedback control loop is implemented with a clocked comparator 101 and the uDSR 110, which operates as the digital controller of the DLDO 100. The value of $V_{out}$ and reference voltage $V_{ref}$ are compared through the comparator 101 at the rising edge of the clock signal clk. The power transistors $M_i$ are turned on or off in the manner described below with reference to FIGS. 6 and 7.

A. Unidirectional Shift Register

To mitigate NBTI-induced $I_{pMOS}$, $T_R$ and ΔV degradations, distributing the electrical stress among all available power transistors as evenly as possible under arbitrary load current conditions is desirable. Reliability is generally not considered in conventional bDSR-based DLDO designs of the type shown in FIG. 1, and therefore too much stress is exerted on a small portion of $M_i$s. A representative embodiment of the uDSR is disclosed herein that evenly distributes the electrical stress among all of the $M_i$s to realize an A-A DLDO with enhanced reliability.

Figure 2:
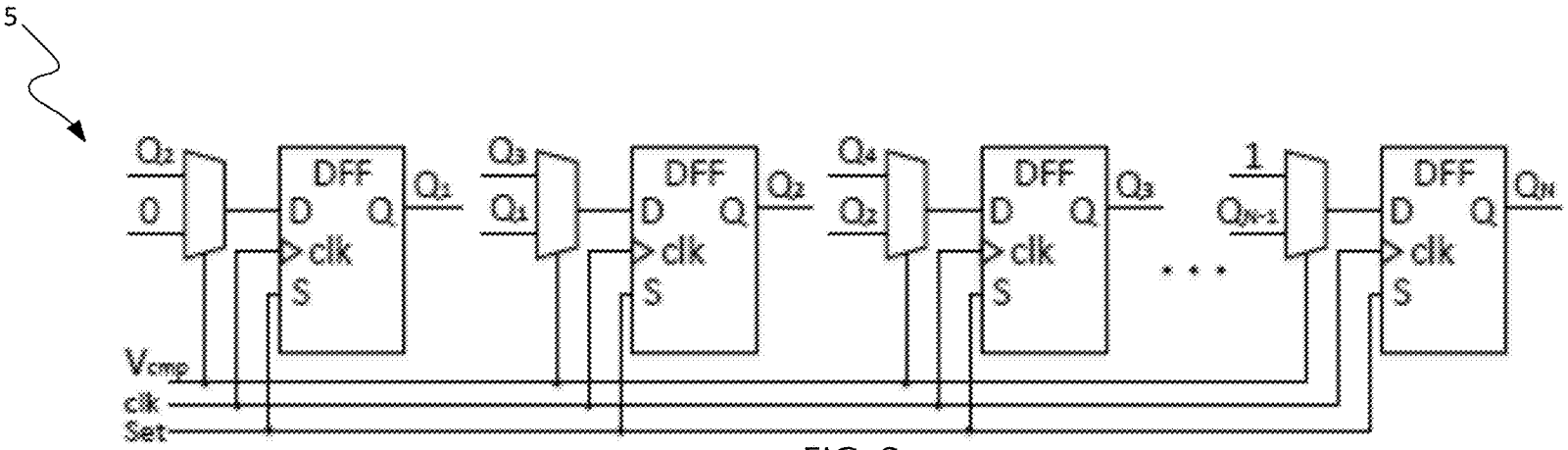
FIG. 2 (PRIOR ART)
FIG. 2 is a bi-directional shift register comprising the digital controller of the conventional DLDO shown in FIG. 1.
Figure 3:
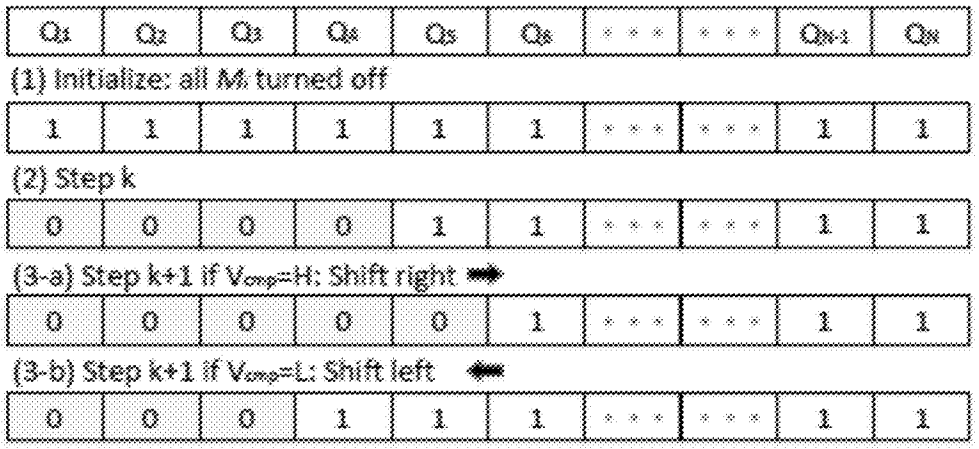
FIG. 3 (PRIOR ART)
FIG. 3 is a diagram showing the operation of the bi-directional shift register shown in FIG. 2.
Figure 6:
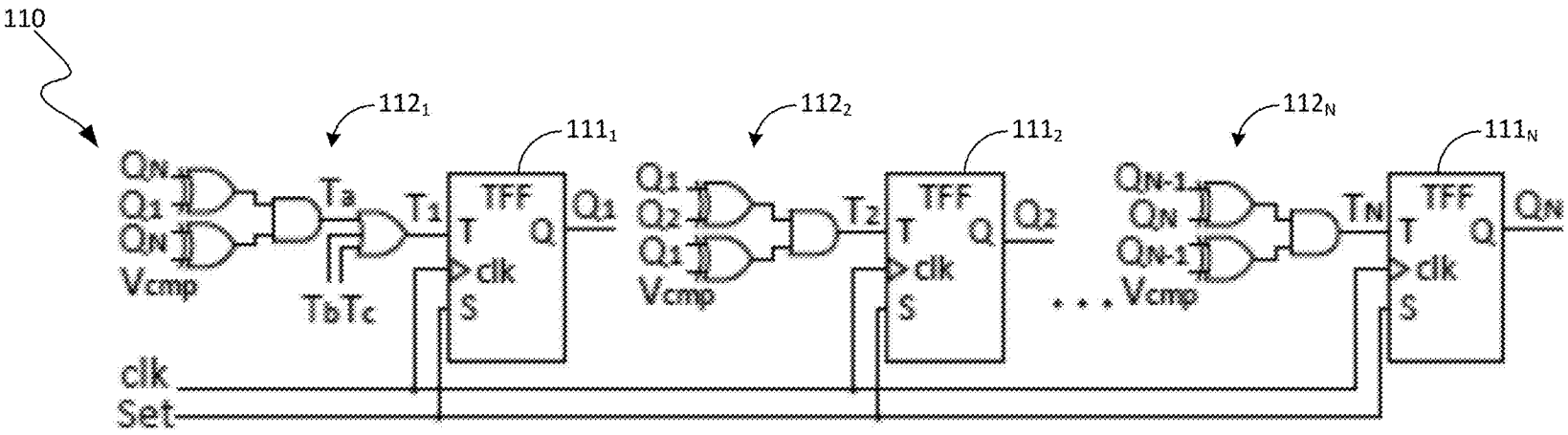
FIG. 6 is a schematic diagram of a uni-directional shift register of the A-A DLDO shown in FIG. 5 in accordance with a representative embodiment.
Figure 7:
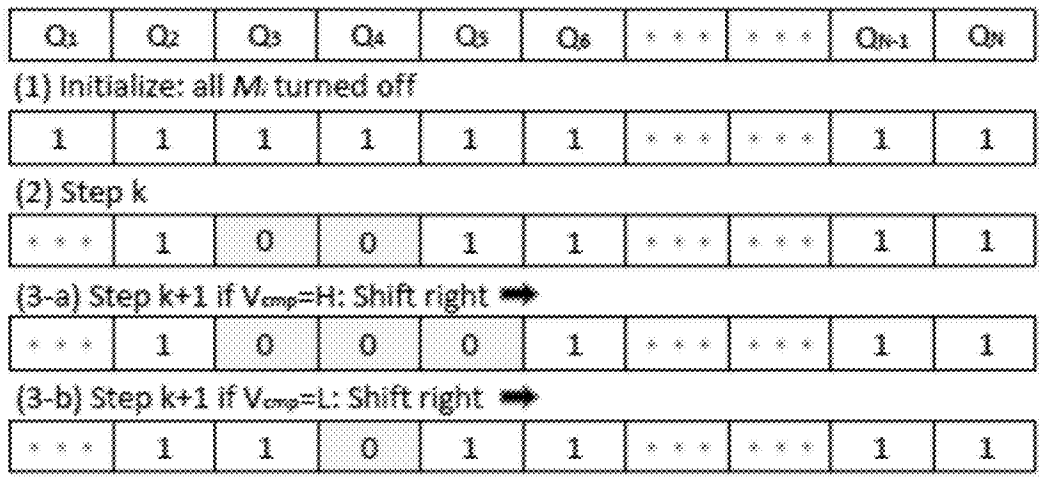
FIG. 7 is a diagram showing the operation of the uni-directional shift register shown in FIG. 6 in accordance with a representative embodiment.

FIG. 6 shows a schematic diagram of the uDSR 110 in accordance with a representative embodiment. FIG. 7 is a diagram showing the manner in which the uDSR 110 operates in accordance with a representative embodiment. In accordance with this representative embodiment, the elementary D flip-flops (DFFs) and the multiplexer within the bDSR shown in FIG. 2 are replaced with T flip-flops (TFFs) $\mathbf{111}_1$-$\mathbf{111}_N$ and a simple combination of logic gates $\mathbf{112}_1$-$\mathbf{112}_N$ within the uDSR 110, respectively. The rest of the DLDO 100, including the parallel power transistors $M_i$s and the clocked comparator 101 can remain unchanged. One of the objectives here is to balance the utilization of each available $M_i$ under all load current conditions. To achieve this objective, control signals $Q_{i-1}$ and $Q_i$ for two adjacent power transistors $M_{i-1}$ and $M_i$, respectively, are XORed to determine if $M_{i-1}$ and $M_i$ are at the boundary of active and inactive power transistor portions. Normally, there are two such boundaries if at least one power transistor is active, as shown in FIG. 7. $Q_{i-1}$ and output of the comparator $V_{cmp}$ are thus XORed by the combinations of logic gates $\mathbf{112}_1$-$\mathbf{112}_N$ to decide which power transistor at the boundaries needs to be turned on/off at the rising edge of the clock signal.

An inactive power transistor at the right boundary is turned on if $V_{cmp}$ is logic high. An active power transistor at the left boundary is turned off if $V_{cmp}$ is logic low. The uDSR 110 is realized through this activation/deactivation scheme, as demonstrated in FIG. 7. $Q_{i-1}$ for the first stage is $Q_N$ from the last stage and thus a loop is formed. Considering the initialization step when all $M_i$s are off and the full load current condition when all $M_i$s are on, additional control signals are inserted as $T_b$ and $T_c$ in the first stage at the combination of logic gates $\mathbf{112}_1$, to avoid inaction under these two situations, where $T_b=Q_1 \cdot Q_2 \ldots Q_N \cdot V_{amp}$ and $T_c=\overline{Q_1+Q_2+\ldots+Q_N+V_{cmp}}$. The logic functions for $T_b$ and $T_c$ can be implemented with n-input AND/NOR gates, for example, as shown in FIG. 6, although other logic gate configurations could be used for this purpose.

1. Steady-State Operation

Figure 10:
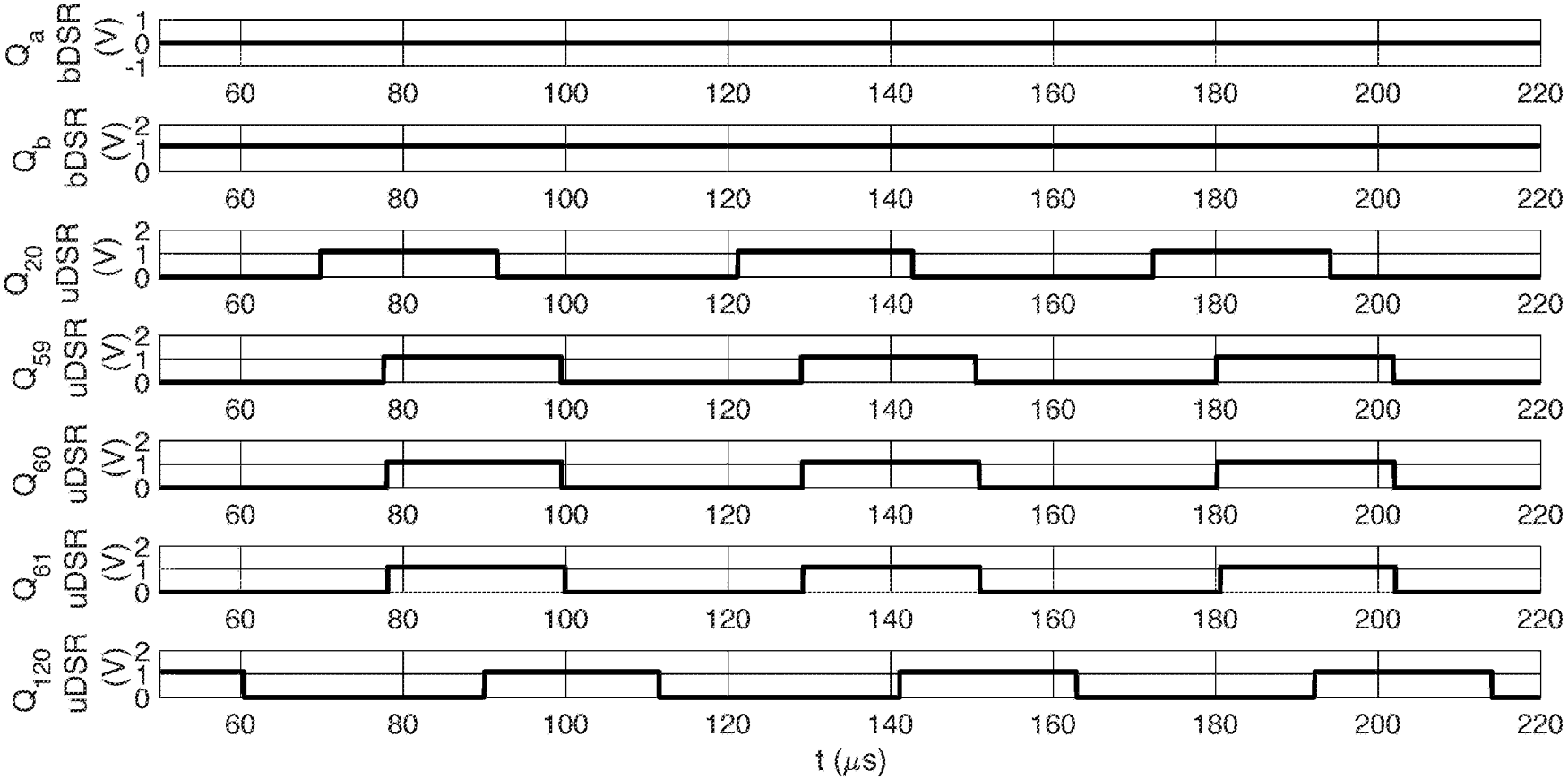
FIG. 10 is a timing diagram demonstrating bDSR control and uDSR control in accordance with FIGS. 8 and 9, respectively, for particular gate signals.

FIGS. 8 and 9 are timing diagrams that represent simulated steady-state gate signals of power transistors with bDSR and uDSR control, respectively, where $Q_a$ ($1 \le a < I_{load}N/I_{max}-M$) and $Q_b$ ($I_{load}N/I_{max}+M<b \le N$) are, respectively, gate signal of active power transistor Ala and inactive power transistor Mb with bDSR control. $Q_i$s ($1 \le i \le N$) all have similar waveforms with uDSR control. For the simulations shown in FIGS. 8 and 9, $I_{load}$=300 mA. The detailed design specifications for the DLDO 100 are described in Section IV-A. As shown in FIG. 8, for bDSR control, power transistor $M_a$s experience electrical stress all of the time while power transistors $M_b$s are always OFF. FIG. 10 is a timing diagram demonstrating bDSR control and uDSR control in accordance with FIGS. 8 and 9, respectively, for particular gate signals. For uDSR control, three randomly picked adjacent power transistor gate signals $Q_{59}$, $Q_{60}$, and $Q_{61}$ together with two additional further separated gate signals $Q_{20}$ and $Q_{120}$ are demonstrated. The falling edge of $Q_{60}$ ($Q_{61}$) demonstrates delay as compared to $Q_{59}$ ($Q_{60}$). However, the percentage of time when power transistor $M_i$ ($1 \le i \le N$) is active is the same for all $M_i$s, and thus, the electrical stress can be more evenly distributed.

2. Transient Load Operation

Figure 11:
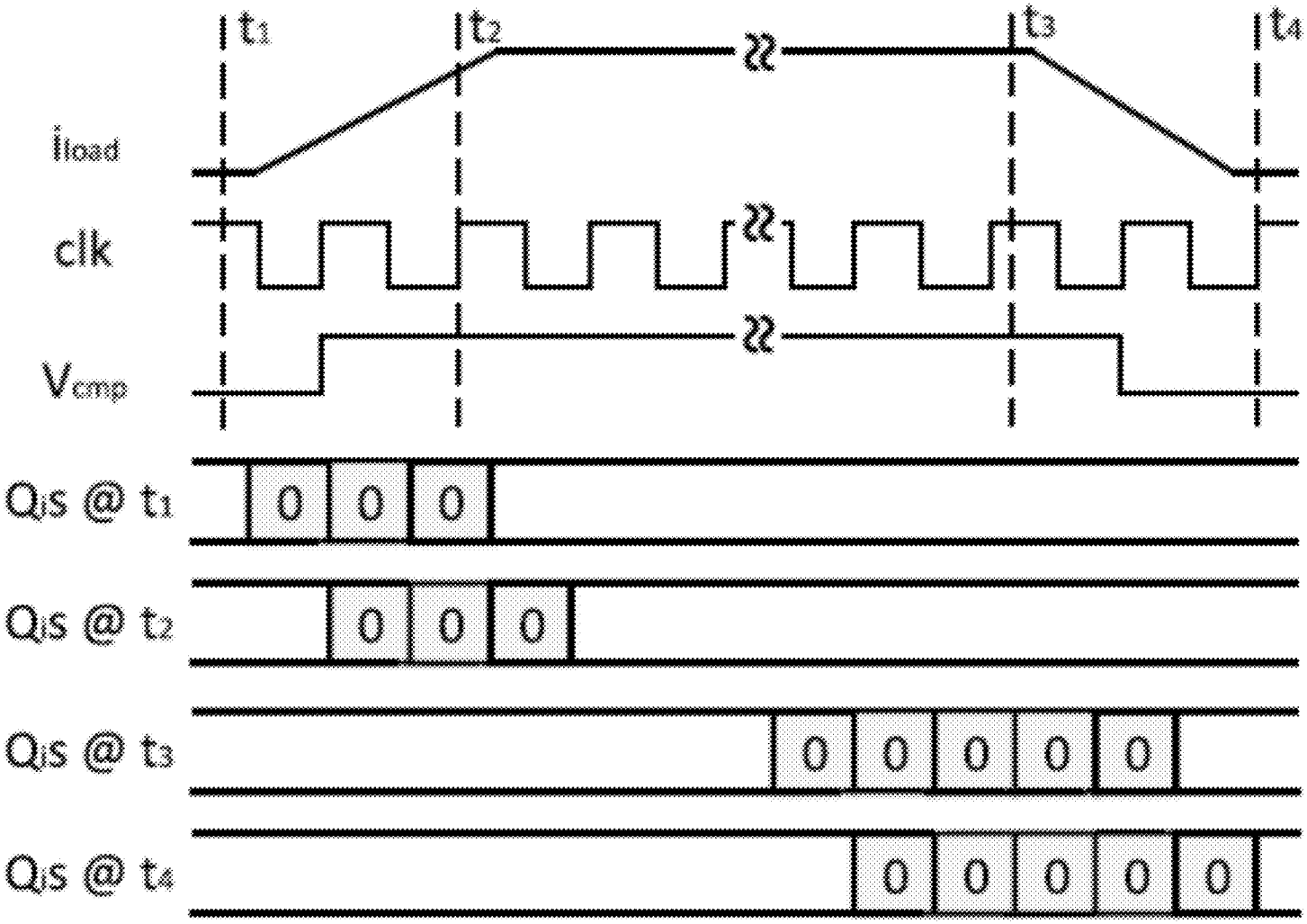
FIG. 11 is a timing diagram that conceptually illustrates transient waveforms and active power transistor locations for the DLDO shown in FIG. 5.

FIG. 11 is a timing diagram that conceptually illustrates transient waveforms and active power transistor locations for the DLDO 100. The operation of uDSR 110 under transient load conditions will be elaborated on with reference to FIG. 11. A step load current with a few clock cycles of rise and fall time is utilized for illustration. Assume at $t_1$ before the load increase, there are three active power transistors on the left side of the power transistor array, the deactivation of power transistor at the left boundary at the next clock rising edge, and the activation of power transistor at the right boundary at the following clock rising edge lead to the updated active power transistor locations at $t_2$. The number of active power transistors continues to increase after $t_2$ and due to the steady-state operation of the uDSR, active power transistors with an increased number move right to reach the new locations at $t_3$. After experiencing one more activation and deactivation of power transistors due to load decrease, the updated locations at $t_4$ (the second clock rising edge after $t_3$) are demonstrated at the bottom in FIG. 11.

Thus, regardless of the load current conditions, electrical stress can always be more evenly distributed among all of the available power transistors of the DLDO 100. Furthermore, as compared to the conventional bDSR-based DLDO 2, the number of activated/deactivated power transistors per clock cycle remains the same, and thus, bDSR and uDSR have the same transfer function S(z). Leveraging uDSR to evenly distribute electrical stress within the power transistor array does not negatively affect control loop performance.

B.1 Overhead

Considering the similar area of DFFs and TFFs, the uDSR 110 only induces ~3.8% area OH per control stage compared to the bDSR 5. The total area OH is −2.6% of a single active DLDO area designed with μA current supply capability. As few extra transistors are added per control stage and the bDSR 5 only consumes a few μW power, the uDSR-induced power OH is also negligible. With a larger $I_{pMOS}$ for higher load current rating, both the area and power OH can be significantly less.

B.2 Compatibility with Quiescent Current Saving Technique

In accordance with a representative embodiment, known freeze mode operation and clock gating techniques are employed in the DLDO 100 to save quiescent current at steady state. For freeze mode operation, the DLDO control circuit can be disabled once the number of active power transistors converges to save the quiescent current. In this case, the operation of the uDSR 110 would also be stopped. However, after many load current changes and different steady-state operations for long-term reliability concern, the active power transistor region (darkened region shown in FIG. 7) still moves rightward and electrical stress can also be more evenly distributed among all of the power transistors as compared to the conventional bidirectional shift method.

Furthermore, in accordance with an embodiment, a known sliding clock gating technique can also be utilized to save the steady-state quiescent current. For this purpose, the power transistor array and the control flip-flops $\mathbf{111}_1$-$\mathbf{111}_N$ are divided into multiple sections with equal number within each section. During steady-state operation, if the left boundary of the active power transistor region falls within one section and the right boundary falls within another section, other sections not covering the two boundaries can be temporarily clock gated to save quiescent current. The active power transistor region still dynamically moves rightward to evenly distribute the electrical stress and the clock-gated sections also dynamically change. For this case, as not all flip-flops are clock gated, the steady-state quiescent current can be higher than that in the freeze mode operation discussed earlier. Thus, the unidirectional shift scheme is still beneficial even when a steady-state quiescent current saving technique is employed. However, a tradeoff exists between the steady-state quiescent current saving and reliability enhancement enabled by the unidirectional shift scheme.

Section IV. Evaluation

To evaluate the benefits of the proposed A-A DLDO architecture in terms of reliability enhancement and to provide design insights for a targeted lifetime, an IBM POWER8 like microprocessor simulation platform is constructed.

A. 1 Simulation Framework

Figures 12, 13:
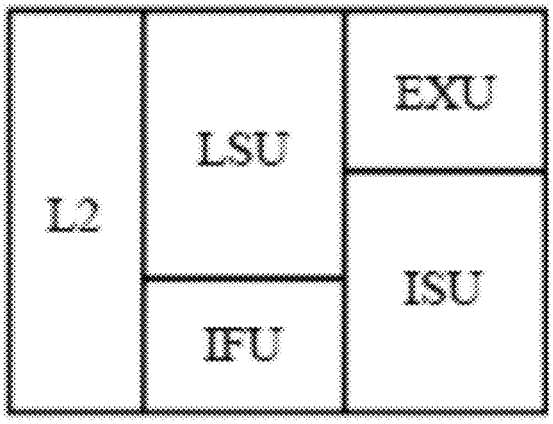
FIG. 12 is a table listing technology and architecture parameters for a simulation that was performed to demonstrate benefits of employing the uni-directional shift register configuration shown in FIG. 6 in a DLDO.
FIG. 13 is a schematic diagram of the functional blocks of one core within an IBM POWER8 like microprocessor chip used in the simulation defined by the architectural parameters listed in the table of FIG. 12.

An IBM POWER8 Like Microprocessor was used for the simulation framework. The IBM POWER8 microprocessor is currently among one of the state-of-the-art server-class processors and, thus, a representative for evaluation of the proposed A-A DLDO design scheme. FIG. 12 contains Table I, which lists the corresponding technology and architecture parameters. FIG. 13 is a block diagram of the IBM POWER8 like microprocessor core, which includes a load store unit (LSU), an execution unit (EXU), an instruction fetch unit (IFU), an instruction scheduling unit (ISU), an L1 data cache inside LSU, an L1 instruction cache inside IFU, and a private L2. All benchmarks are from SPALSH2x and cover a wide range of representative application domains. Analysis is restricted to the region of interest of the benchmarks and eight threads are involved in the simulations. Table II shown in FIG. 14 is a summary of the load characteristics of different functional blocks under all experimented benchmarks.

A.2 DLDO Design Specifications

Distributed microregulators are implemented in IBM POWER8 microprocessor. In this simulation example, a switch array of 256 pMOS transistors, which is typical in DLDO designs, is implemented in each microregulator. Two different DLDO designs with bDSR and uDSR controls are implemented using 32-nm PTM CMOS technology where $V_{in}$=1.1V and $V_{out}$=1V. In the simulation, $I_{pMOS}$=2 mA and $I_{max}$=512 mA are used, leading to 7, 24, 3, 10, and 5 microregulators (DLDOs) in the, respectively, IFU, LSU, ISU, EXU, and L2 blocks shown in FIG. 13 to be able to supply the maximum load current across all benchmarks in each block. Load current of each block is assumed to be supplied by microregulators within that block, which is reasonable due to the principle of spatial locality regarding current distribution. Each microregulator within a certain block is assumed to provide equal current due to the availability of current balancing scheme implemented within IBM POWER8 microprocessor. In the simulation, $f_{clk}$=10 MHz and C=15 nF are used for each DLDO to achieve smaller than 10% Vdd transient voltage noise most of the time. The total output capacitance is 735 nF. As resonant clock meshes are already deployed within IBM POWER8 processor, the complexity and OH of generating and distributing the clock signal for the DLDOs can be frequency dividers consisting of simple flip-flops and localized routing wires.

A. 3 Evaluation of Aging-Induced Performance Degradation

Equations (1), (3), (6), and (8) are leveraged for the evaluation of aging-induced performance degradation. A typical temperature profile of 90° C., 69° C., 67° C., 63° C., and 62° C. for, respectively, LSU, EXU, IFU, ISU, and L2 is adopted for evaluations. The activity factors for both DLDO designs under different benchmarks and functional blocks are estimated through simulations in Cadence Virtuoso. The worst case $I_{pMOS}$ degradations are used for evaluations of both designs, which is reasonable due to load characteristics of typical applications and the consequent heavy use of a portion of Ms in conventional DLDOs.

B. 1 Simulation Results: Performance Degradation Within Conventional DLDO

Table III shown in FIG. 15 lists a summary of the conventional DLDO performance degradation regarding $I_{pMOS}$, $T_R$, and ΔV for different functional blocks for a 5-year time frame. These degradations apply to all the experimented benchmarks as the worst case $I_{pMOS}$ degradation is considered. As shown in Table III, NBTI can induce serious $I_{pMOS}$, $T_R$, and ΔV degradations for all functional blocks. $I_{pMOS}$ degradation can lead to the deterioration of DLDO $V_{out}$ regulation capability and possible $V_{out}$ drop under large load current conditions. Larger than 10% $V_{out}$ drop can lead to voltage emergencies and potential execution errors for microprocessors. Similarly, $T_R$ and ΔV degradations can, respectively, increase the duration and frequency of voltage emergencies, which can slow down microprocessor executions as further actions may need to be taken to remedy the errors. Moreover, for a longer targeted lifetime of more than 5 years, the degradations are expected to be more disastrous, as $I_{pMOS}$ degradations are even worse, as seen from FIG. 4, which may not be tolerable for critical applications where the replacement of the devices can be costly or even impossible.

B. 2 Simulation Results: $I_{pMOS}$, $T_R$, and ΔV Mitigation with the Aging-Aware DLDO Simulation results for all benchmarks for 4MOS, $T_R$, and ΔV degradation mitigation of the uDSR-based DLDO 100 as compared to the conventional DLDO design for a 5-year time frame indicated up to 39.6%, 43.2%, and 42% performance improvement is achieved for, respectively, $I_{pMOS}$, $T_R$, and ΔV. The highest performance improvement is obtained for the LSU functional block with the highest operation temperature. Even at the lowest operation temperature within the L2 functional block, degradation mitigations of up to 15.1%, 16.4%, and 15.9% are achieved for, respectively, $I_{pMOS}$, $T_R$, and ΔV.

V. Conclusions

The DLDO regulators can experience serious NBTI induced performance degradations including $I_{pMOS}$, $T_R$, and ΔV. These degradations are typically overlooked in the design of DLDOs and can deteriorate the regulation capability, response speed, and transient voltage noise profile. The present disclosure discloses a representative embodiment of a uni-directional shift register that evenly distributes the electrical stress among different power transistors to mitigate NBTI induced performance degradation with nearly no extra power and area overhead under arbitrary load conditions. Through practical simulations of an IBM POWER8 like microprocessor and benchmark evaluations, it is demonstrated that up to 39.6%, 43.2%, and 42% degradation mitigation can be achieved for, respectively, $I_{pMOS}$, $T_R$, and ΔV with the methods and apparatuses disclosed herein. Simulation results also highlight the necessity of adaptive design margins to avoid overdesign.

It should be noted that the illustrative embodiments have been described with reference to a few embodiments for the purpose of demonstrating the principles and concepts of the invention. Persons of skill in the art will understand how the principles and concepts of the invention can be applied to other embodiments not explicitly described herein. For example, while the DLDO and the uDSR have been described with reference to FIGS. 6 and 7, respectively, as having particular configurations, those skilled in the art will understand that many modifications can be made to the configurations shown in FIGS. 6 and 7 while still achieving the goals and benefits described herein. As will be understood by those skilled in the art in view of the description provided herein, such modifications are within the scope of the invention.

What is claimed is:

1. A digital low-dropout voltage regulator (DLDO) having a configuration that mitigates performance degradation of the DLDO caused by effects of aging on power transistors of the DLDO, the DLDO comprising:

a clocked comparator circuit having at least first and second input terminals and an output terminal, the first terminal receiving a reference voltage $V_{ref}$, the second input terminal receiving an output voltage signal $V_{out}$ output from an output voltage terminal of the DLDO, the comparator comparing the reference voltage signal with the output voltage signal and outputting a comparator output voltage signal, $V_{cmp}$;

an array of N power transistors electrically connected in parallel with one another, where N is a positive integer that is greater than or equal to one, each power transistor having first, second and third terminals, the first terminal of each power transistor being electrically coupled to the output voltage terminal of the DLDO; and a digital controller comprising control logic configured to activate and deactivate the power transistors of the DLDO in accordance with a preselected activation/deactivation control scheme that causes the power transistors to be turned ON or OFF, wherein the preselected activation/deactivation control scheme ensures that the power transistors are turned ON or OFF in a way that evenly distributes electrical stress among the power transistors over time to thereby mitigate performance degradation of the DLDO caused by the effects of aging on the power transistors, the second terminal of each power transistor being electrically coupled to a respective output terminal of the digital controller for receiving a respective one of the control signals from the digital controller.

2. The DLDO of claim 1, wherein the control logic comprises a uni-directional shift register.

3. The DLDO of claim 2, wherein the control signals turn the power transistors ON or OFF in such a way that the power transistors are substantially evenly utilized over time to mitigate performance degradation of the DLDO.

4. The DLDO of claim 2, wherein the control signals turn an inactive power transistor at a right boundary of active and inactive power transistors ON if $V_{cmp}$ is a logic high and turn an active power transistor at a left boundary of active and inactive power transistors OFF if $V_{cmp}$ is a logic low.

5. The DLDO of claim 4, wherein the control logic further comprises N combinations of logic gates and wherein the shift register comprises N flip flops, each flip flop having a first input terminal that is electrically coupled to an output terminal of one of the N combinations of logic gates, each of the N combinations of logic gates processing the comparator output voltage signal, $V_{cmp}$, and a respective pair of control signals output from a respective pair of adjacent output terminals of the digital controller, and wherein a combination of the processes performed by the N combinations of logic gates and the respective flip flops result in the control logic (1) locating the left and right boundaries, (2) turning ON an inactive power transistor at the right boundary if $V_{cmp}$ is a logic high, and (3) turning OFF an active power transistor at the left boundary if $V_{cmp}$ is a logic low.

6. The apparatus of claim 1, wherein the power transistors are p-type metal oxide semiconductor field effect (pMOS) transistors.

7. The apparatus of claim 6, wherein the effects of aging on the power transistors are caused, at least in part, by negative bias temperature instability (NBTI).

8. The apparatus of claim 1, wherein the power transistors are n-type metal oxide semiconductor field effect (nmos) transistors.

9. The apparatus of claim 8, wherein the effects of aging on the power transistors are caused, at least in part, by positive bias temperature instability (PBTI).

10. A method for mitigating performance degradation in a digital low-dropout voltage regulator (DLDO) caused by effects of aging on power transistors, the method comprising:

in a clocked comparator of the DLDO, receiving a reference voltage signal, $V_{ref}$, at a first input terminal of the clocked comparator, receiving an output voltage signal, $V_{out}$, output from an output voltage terminal of the DLDO at a second input terminal of the clocked comparator, and receiving a DLDO clock signal, clk, at a clock terminal of the clocked comparator;

in the clocked comparator, comparing the reference voltage signal, $V_{ref}$, with the output voltage signal, $V_{out}$, and outputting a comparator output voltage, $V_{cmp}$; and in a digital controller of the DLDO, receiving the comparator output voltage, $V_{cmp}$, at an input terminal of the digital controller and performing a preselected activation/deactivation control scheme that causes the digital controller to send control signals to an array of power transistors of the DLDO to cause the power transistors to be turned ON or OFF in accordance with the preselected activation/deactivation control scheme, wherein the preselected activation/deactivation control scheme ensures that the power transistors are turned ON or OFF in a way that evenly distribute electrical stress among the power transistors over time to thereby mitigate performance degradation of the DLDO caused by the effects of aging on the power transistors, each power transistor having first, second and third terminals, the first terminal of each power transistor being electrically coupled to the output voltage terminal of the DLDO, the second terminal of each power transistor being electrically coupled to one of the output terminals of the digital controller for receiving one of the control signals from the digital controller.

11. The method of claim 10, wherein the DLDO comprises control logic configured to perform the preselected activation/deactivation control scheme, the control logic comprising a uni-directional shift register.

12. The method of claim 11, wherein the control signals turn the power transistors ON or OFF in such in a way that the power transistors are substantially evenly utilized over time to mitigate performance degradation of the DLDO caused by the effects of aging on the power transistors.

13. The method of claim 11, wherein the control signals turn an inactive power transistor at a right boundary of active and inactive power transistors ON if $V_{cmp}$ is a logic high and turn an active power transistor at a left boundary of active and inactive power transistors OFF if $V_{cmp}$ is a logic low.

14. The method of claim 13, wherein the control logic further comprises N combinations of logic gates and wherein the shift register comprises N flip flops, each flip flop having a first input terminal that is electrically coupled to an output terminal of one of the N combinations of logic gates, the method further comprising:

with each of the N combinations of logic gates, processing the comparator output voltage signal, $V_{cmp}$, and a respective pair of control signals output from a respective pair of adjacent output terminals of the digital controller, and wherein a combination of the processes performed by the N combinations of logic gates and the respective flip flops result in the control logic (1) locating the left and right boundaries, (2) turning ON an inactive power transistor at the right boundary if $V_{cmp}$ is a logic high, and (3) turning OFF an active power transistor at the left boundary if $V_{cmp}$ is a logic low.

15. The method of claim 10, wherein the power transistors are p-type metal oxide semiconductor field effect (pMOS) transistors.

16. The method of claim 15, wherein the effects of aging on the power transistors are caused, at least in part, by negative bias temperature instability (NBTI).

17. The method of claim 10, wherein the power transistors are n-type metal oxide semiconductor field effect (nmos) transistors.

18. The method of claim 17, wherein the effects of aging on the power transistors are caused, at least in part, by positive bias temperature instability (PBTI).

19. A method for mitigating performance degradation in a digital low-dropout voltage regulator (DLDO) caused by the effects of aging on power transistors of the DLDO, the method comprising:

with shift register of a digital controller of the DLDO, outputting control signals that cause power transistors of the DLDO to be turned ON or OFF in accordance with a preselected activation/deactivation control scheme, wherein the preselected activation/deactivation control scheme ensures that the power transistors are turned ON or OFF in a way that evenly distributes electrical stress among the power transistors over time to thereby mitigate performance degradation of the DLDO caused by the effects of aging on the power transistors.

20. The method of claim 19, wherein the shift register is a uni-directional shift register, and wherein the control signals turn an inactive power transistor at a right boundary of active and inactive power transistors ON if $V_{cmp}$ is a logic high and turn an active power transistor at a left boundary of active and inactive power transistors OFF if $V_{cmp}$ is a logic low.

* * * * *